US005678739A

United States Patent [19]

Darling et al.

[11] Patent Number: 5,678,739

[45] Date of Patent: Oct. 21, 1997

[54] INFANT CARRIER WITH HARNESS AND DETACHABLE SHELL

[75] Inventors: Sandra M. Darling; Curt J. Mahlstedt, both of East Aurora, N.Y.

[73] Assignee: Fisher-Price, Inc., East Aurora, N.Y.

[21] Appl. No.: 531,856

[22] Filed: Sep. 21, 1995

[51] Int. Cl.[6] ..... A61G 1/00

[52] U.S. Cl. ..... 224/160; 224/158; 224/575

[58] Field of Search ..... 224/158–161, 224/575; D3/213, 214; 190/1, 2, 110

[56] References Cited

U.S. PATENT DOCUMENTS

| | | | |
|---|---|---|---|
| 1,464,404 | 8/1923 | Blekastad . | |
| 2,537,864 | 1/1951 | Skaer . | |
| 2,550,851 | 5/1951 | Nichols . | |
| 3,027,058 | 3/1962 | Huber | 224/160 |
| 3,197,100 | 7/1965 | Thompson . | |
| 3,229,873 | 1/1966 | Hershman | 224/160 |
| 3,587,952 | 6/1971 | Higuchi | 224/160 |
| 3,780,919 | 12/1973 | Hansson . | |
| 3,841,543 | 10/1974 | Bolton | 224/158 |
| 4,009,808 | 3/1977 | Sharp . | |
| 4,138,099 | 2/1979 | Englehart | 269/17 |
| 4,324,430 | 4/1982 | Dimas, Jr. et al. | 297/250 |

(List continued on next page.)

FOREIGN PATENT DOCUMENTS

| | | | |
|---|---|---|---|
| 132910 | 9/1947 | Australia | 224/158 |
| 929949 | 1/1948 | France | 224/161 |
| 2481093 | 10/1981 | France . | |
| 2577771 | 8/1986 | France | 190/110 |
| 2642946 | 8/1990 | France . | |
| 349382 | 11/1960 | Switzerland . | |
| 2026848 | 2/1980 | United Kingdom . | |
| 2028633 | 3/1980 | United Kingdom . | |
| 2140275 | 11/1984 | United Kingdom . | |
| 92016130 | 10/1992 | WIPO | 224/160 |

OTHER PUBLICATIONS

"Carrying Made Easy", World.
Advertisement, BabyBjorn, Baby Carrier.
Advertisement, Kapoochi, The Multi–Purpose Baby Pouch & Child Restraint.
Instructions, Tot Tenders, Inc., 6–Position Baby Carrier.
"Gerry Escort" Baby Carrier, date unknown, 1 page.
Instructions for "Papoose" Baby Carrier, date unknown, 1 page.

(List continued on next page.)

*Primary Examiner*—Henry J. Recla
*Assistant Examiner*—Gregory M. Vidovich
*Attorney, Agent, or Firm*—Morgan, Lewis and Bockius LLP; C. Scott Talbot; Michele Van Patten Frank

[57] ABSTRACT

A front infant carrier which includes a vest-like harness that is worn by the attendant, a detachable infant shell, and a sling. The detachable infant shell attaches to the harness at three attachment points, either in a forward-facing or rearward-facing orientation. In the rearward-facing position, the shell attaches to the harness by a peg/button mounted at the crotch of the shell which snaps into a socket centrally mounted at the lower front of the harness, and by a pair of upper clips on the shell which engage rings on the upper front of the harness. The forward-facing attachment uses a second peg/button at the lower back portion of the shell, instead of the crotch peg/button, and attaches in a similar fashion, whereby the second peg/button snaps into the socket centrally mounted at the lower front of the harness, and the pair of upper clips on the shell engage the rings on the upper front of the harness. A sling may also be attached to the harness at three points, the sling having a third peg/button which mates with the socket centrally mounted at the lower front of the harness and has a pair of upper clips which engage the rings on the upper front of the harness. The sling may be attached so that the disengaged shell and carried infant may be rested sideways within the sling. The sling is reinforced with sewn-in battens to help provide support for the infant to rest in the sling alternatively without the shell.

21 Claims, 18 Drawing Sheets

U.S. PATENT DOCUMENTS

| | | | |
|---|---|---|---|
| 4,402,440 | 9/1983 | Purtzer et al. | 224/160 |
| 4,419,794 | 12/1983 | Horton, Jr. et al. | 224/197 |
| 4,428,514 | 1/1984 | Elf | 224/151 |
| 4,568,125 | 2/1986 | Sckolnik | 297/467 |
| 4,579,264 | 4/1986 | Napolitano | 224/160 |
| 4,724,988 | 2/1988 | Tucker | 224/160 |
| 4,903,873 | 2/1990 | Poole et al. | 224/160 |
| 4,986,458 | 1/1991 | Linday | 224/160 |
| 5,051,021 | 9/1991 | Pelz | 403/406.1 |
| 5,054,170 | 10/1991 | Otrusina | 224/197 |
| 5,178,309 | 1/1993 | Bicheler et al. | 224/153 |
| 5,205,451 | 4/1993 | Manzer | 224/161 |
| 5,246,152 | 9/1993 | Dotseth | 224/159 |
| 5,490,620 | 2/1996 | Bergqvist | 224/160 |
| 5,522,528 | 6/1996 | Petricola | 224/161 |

OTHER PUBLICATIONS

Baby Carrier Literature from "Baby Bjorn" Catalog, date unknown, 3 pages.

Instructions for Fisher–Price "Ride–Along Carrier," 1989, 8 pages.

Advertisement, Cuddle Me.

Evenflo, Great Adventures, Baby Carrier, 0–24 Months.

Evenflo, Grand Tour, Baby Carrier, 0–18 Months.

Snugli, Legacy, 0–18 Months, Model No. 018.

Snugli, Embrace, 0–9 Months, Model No. not available.

Snugli, Cuddler, 0–6 Months, Model No. 041.

Snugli, Escort Double Take, 0–9 Months, Model No. 045.

Snugli, Escort, 0–9 Months, Model No. 042.

INFANT CARRIER WITH HARNESS AND DETACHABLE SHELL

BACKGROUND OF THE INVENTION

This invention relates generally to devices providing for the carrying of an infant by an adult. More specifically, the invention relates to a flexible infant carrier which may be adjusted to accommodate several different configurations, including one configuration orienting the infant carrier such that the infant is facing the adult, another configuration wherein the infant is facing the adult draped with a sling to serve as an additional protector, yet another configuration wherein the infant is facing outward, in the direction the adult is facing, and finally, two sling configurations, one wherein the infant is cradled in a sling attached to the harness at five points to facilitate private nursing and another wherein the sling is attached to the harness at four points to facilitate carrying the infant.

The demands of today's fast-paced society have created a need for an device by which an adult attendant may carry an infant without compromising the free and independent movement and volition of the adult's shoulders and arms. In order to accomplish the everyday tasks associated with caring for a child, an adult must oftentimes take the infant on errands and chores. Responding to this problem, many devices have been created to provide an adult with hands-free carriage of an infant, thereby allowing the adult to perform routine tasks while still caring for the infant.

Numerous devices have been developed over the years for providing a carrier for an infant which is supported by the body of the wearer. Perhaps the most prevalent type of carrier is the so-called backpack type which supports the infant from the shoulders of the wearer and positions the infant on the back of the wearer, much like a conventional backpack. For example, U.S. Pat. No. 3,179,100 to Thompson discloses a backpack carrier for carrying a child in a piggy-back fashion comprising a unitary flexible body of elongated generally rectangular form defining front and rear end portions at opposite ends, including a pair of shoulder encircling loops connected to opposite sides of the front end portion for application to the shoulders of the person carrying the child. Back carriers of this type present several disadvantages among which it is noted that after the carrier is positioned on the shoulders, it is difficult to get the child into the carrier and remove him therefrom. The difficulty and awkwardness associated with mounting and dismounting a backpack type infant carrier presents serious problems. Also, back-worn infant carriers do not provide the wearer with face-to-face contact with the infant or the ability to observe the infant.

Although front-worn carriers address some of these problems, the known front-worn carriers may oftentimes prove to be cumbersome and awkward to use. In many cases, mounting and dismounting the infant is difficult as well as awkward, more often than not requiring assistance. For example, U.S. Pat. No. 4,724,988 to Tucker discloses an infant carrier which provides for the forward facing carriage of an infant at the front of an adult. The device includes panels and shoulder harnesses configured so that when the infant carrier is worn, the infant is received within the carrier with its buttocks resting against the region where the front and back panels are attached and with the back of its thighs supported by the front panel. The carrier also provides a four way restraint system for the infant, comprised of two shoulder straps and two lateral restraints. However, the multiplicity of straps and restraints associated with this invention make mounting and dismounting cumbersome and time consuming. Akin to backpack type carriers, the difficulty and awkwardness is primarily attributable to the fact that the infant must remain in the carrier during mounting and dismounting of the carrier from the shoulders of the wearer unless assistance is available.

There are carriers which may carry the infant on the wearer's back as well as the wearer's front and which may permit the infant to be carried either forward facing (away from the wearer) or rearward facing (toward the wearer). For example, U.S. Pat. No. 4,402,440 to Purtzer et al. discloses an infant carrier with two major components, a harness and a pouch. The harness has a generally rectangular fabric panel which is strapped to the body by means of shoulder straps and waist straps. The harness has a pair of upper and lower dowel receiving rings. The pouch has two leg holes and a back and head support section. The pouch is detachably engaged with the harness by means of four dowels which mate with the dowel receiving rings of the harness. The harness can be mounted on the front of the person or the back of the person depending on where the child is to be carried, either front or back respectively. The pouch can also be mounted to the harness in either a forward facing or rearward facing orientation. However, this carrier suffers the disadvantage that the pouch portion is not easily and conveniently detachable from, or attachable to, the harness portion with the infant in the pouch, since it requires the wearer to disengage, or engage, each of the dowel and ring connections at four attachment points.

Carriers of a sling type have also been provided, generally supported from a shoulder of the attendant. The infant is retained in position by virtue of the sling support depending from the wearer's shoulders. For example, U.S. Pat. No. 4,986,458 to Linday discloses an infant carrier adaptable to support an infant selectively and interchangeably on the front or on the side of an adult. The carrier includes a child supporting flexible pouch and an integral harness, wherein the harness includes adjustable shoulder straps and an adjustable girth strap and the pouch has draw cord means for adjusting the configuration of the pouch. The girth strap has complimentary coupling members adjustably located toward the outer free ends thereof to permit the girth to be coupled to provide a lower torso encircling loop. Sling carriers have the notable disadvantage of being limited for use with only small infants and generally are incapable of adjusting for an infant's growth. Moreover, the attendant's hands sometimes must be used to cradle the child while in the sling, as the sling sometimes does not provide for adequate support of the child.

The foregoing demonstrates a need for a front infant carrier which (1) allows for quick and easy removal of the infant from the carrier; (2) allows the child to be oriented either forward-facing or rearward facing; (3) distributes the weight of the infant for the comfort of the wearer; and (4) provides a sling that can support the infant.

SUMMARY OF THE INVENTION

Accordingly, it is an object of the present invention to overcome the deficiencies noted above. The front infant carrier of the invention meets these needs and overcomes the disadvantages and drawbacks of the prior art by providing a front infant carrier which includes a vest-like harness that is worn by the attendant, a detachable infant shell, and a sling. The vest-like harness includes a rear belt portion which provides for distribution of the infant's weight to the wearer's lower back.

The detachable infant shell attaches to the harness at three attachment points, either in a forward-facing or rearward-facing orientation. In the rearward-facing position, the shell attaches to the harness by a peg/button mounted at the crotch of the shell which snaps into a socket centrally mounted at the lower front of the harness, and by a pair of upper clips on the shell which engage clips on the upper front of the harness.

In the forward-facing position, the shell attaches using a second peg/button at the lower back portion of the shell, instead of the crotch peg/button, and attaches in a similar fashion, whereby the second peg/button snaps into the socket centrally mounted at the lower front of the harness, and the pair of upper clips on the shell engage the clips on the upper front of the harness.

A sling may also be attached to the harness at five points, the sling having a third peg/button which mates with the socket centrally mounted at the lower front of the harness, a pair of upper clips which engage rings located on the upper front of the harness just above the harness mounting clips and straps on the lower corners of the sling that clip to side clips or the waist belt of the harness. The sling also may be attached with both upper clips mounted to one of the rings, so that the disengaged shell and carried infant may be rested sideways within the sling. The sling is reinforced with sewn-in battens to help provide support for the infant to rest in the sling alternatively without the shell. In another configuration, the sling surrounds the outside of the shell and serves as a weather guard or privacy element. When the sling is used as a weather guard to surround the shell attached to the harness, then the third peg/button is not used, since one of the shell pegs/buttons is connected to the socket.

DETAILED DESCRIPTION

Figure 1:
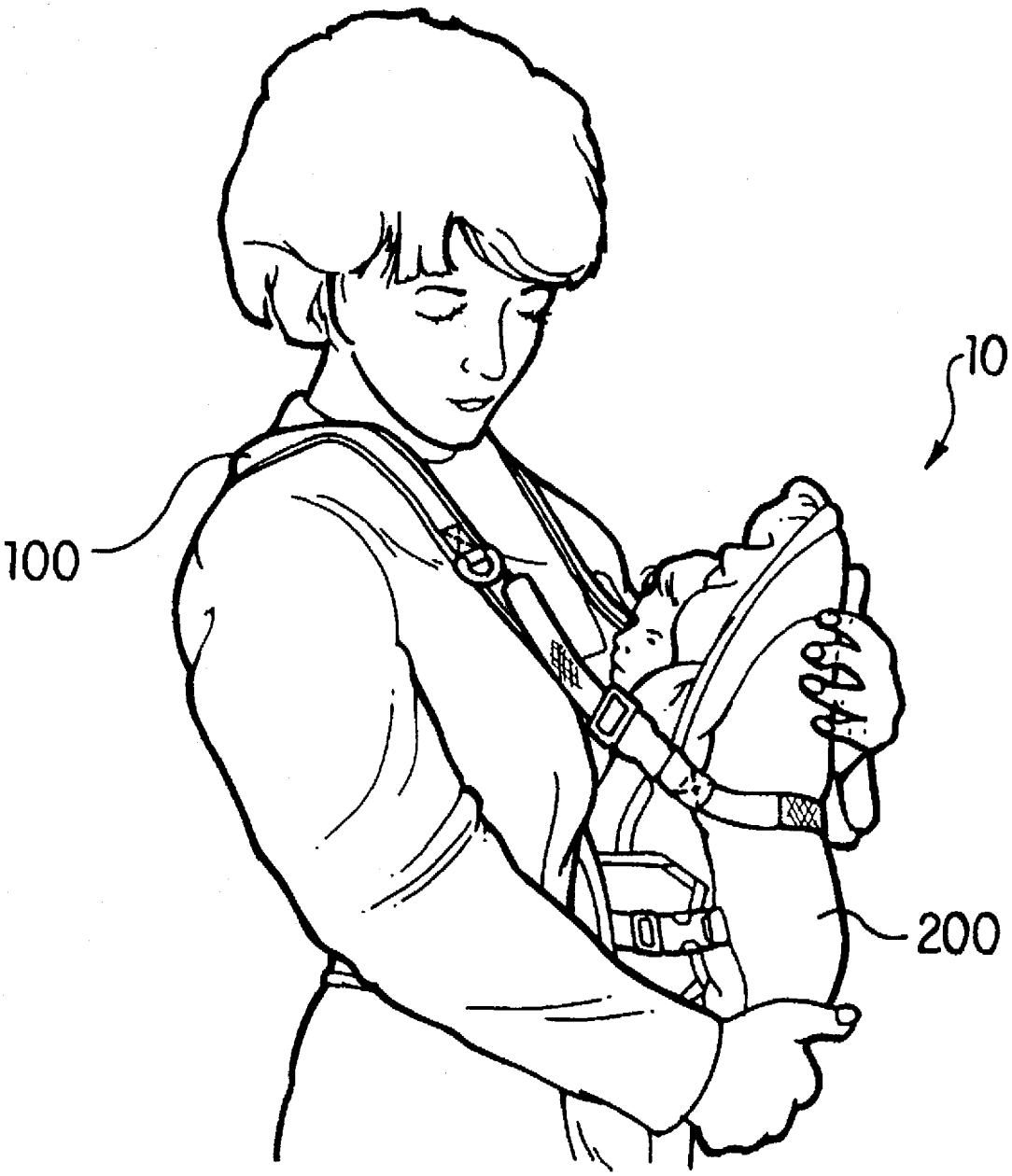
FIG. 1 shows a perspective view of the front infant carrier constructed in accordance with a preferred embodiment the invention when in its rearward facing position.

The invention is described and illustrated below in the context of an infant carrier, although the invention may be applicable to other devices. Referring to FIGS. 1 to 13 of the attached drawings, preferred embodiments of the present invention will now be described. A front infant carrier 10 is illustrated generally in FIG. 1 and FIGS. 2A through 2E. The major components of the front infant carrier are a harness 100, a shell 200, a sling 300 and a bib attachment 400. As further described below, the shell 200 releasably attaches to the harness 100 in one of two ways, either facing forward (away from the wearer) or facing rearward (toward the wearer). In addition, the sling 300 may be attached to the harness 100 with or without the shell 200 attached to the harness 100.

Figure 3:
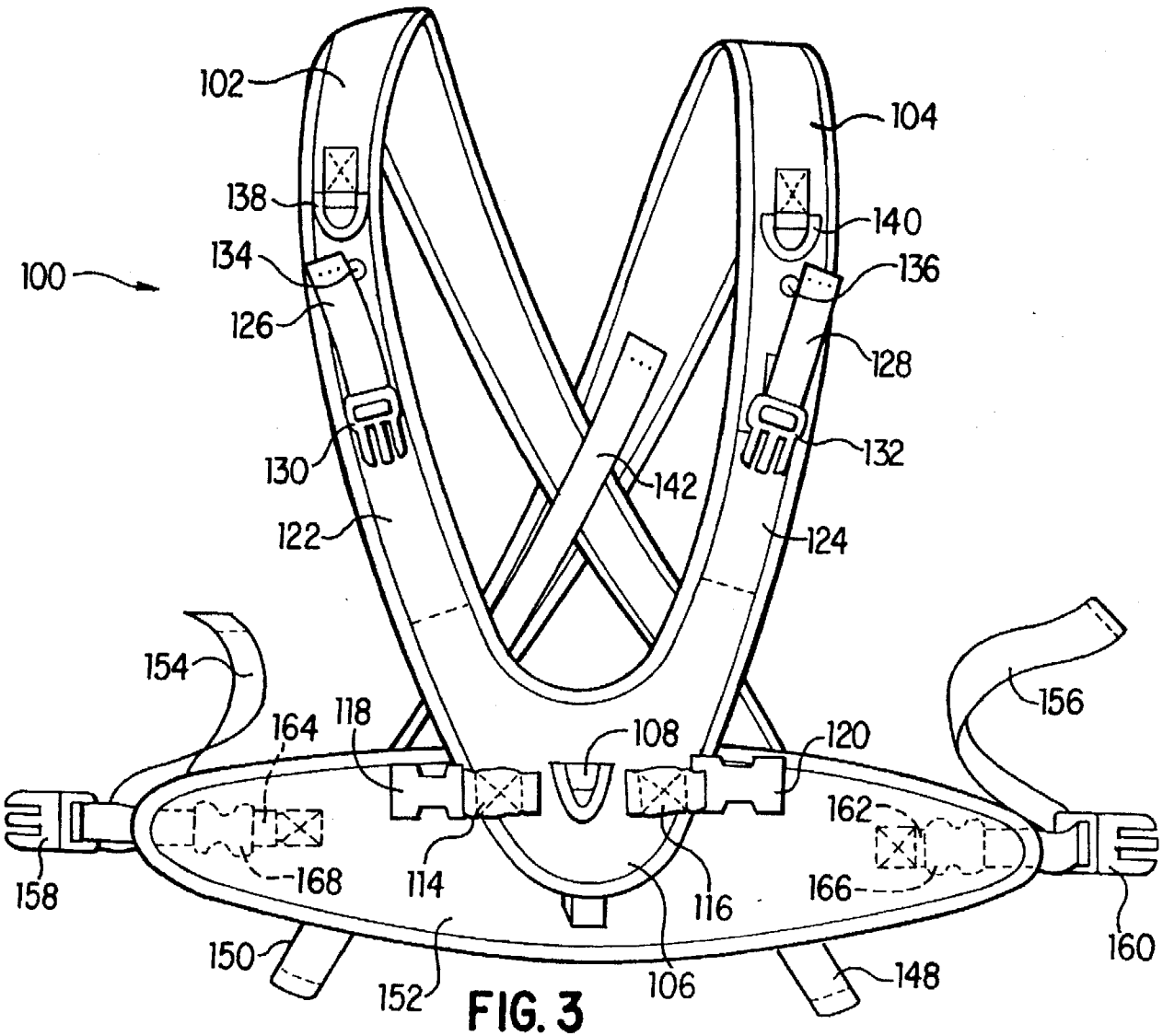
FIG. 3 is a front view of the harness.
Figure 4:
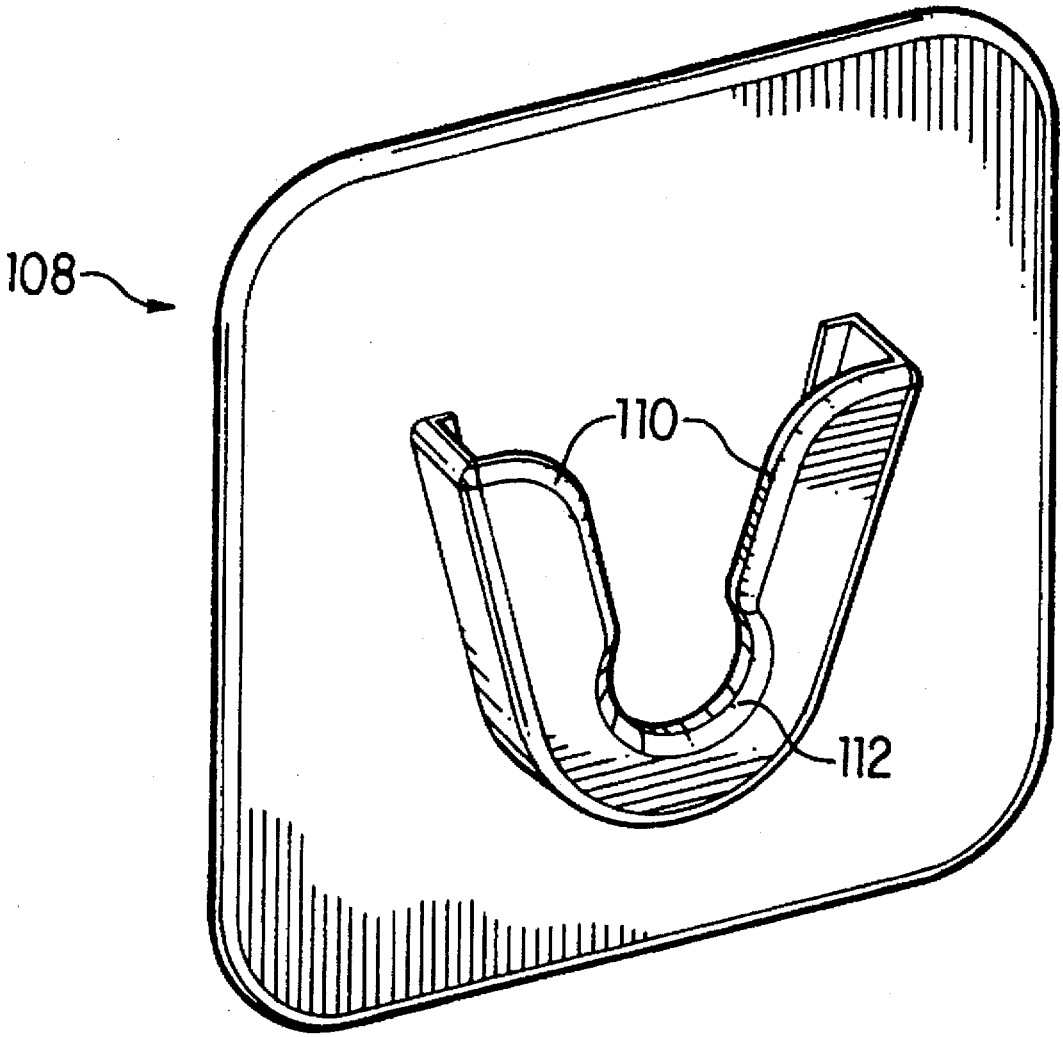
FIG. 4 shows a perspective view of the socket.
Figure 5:
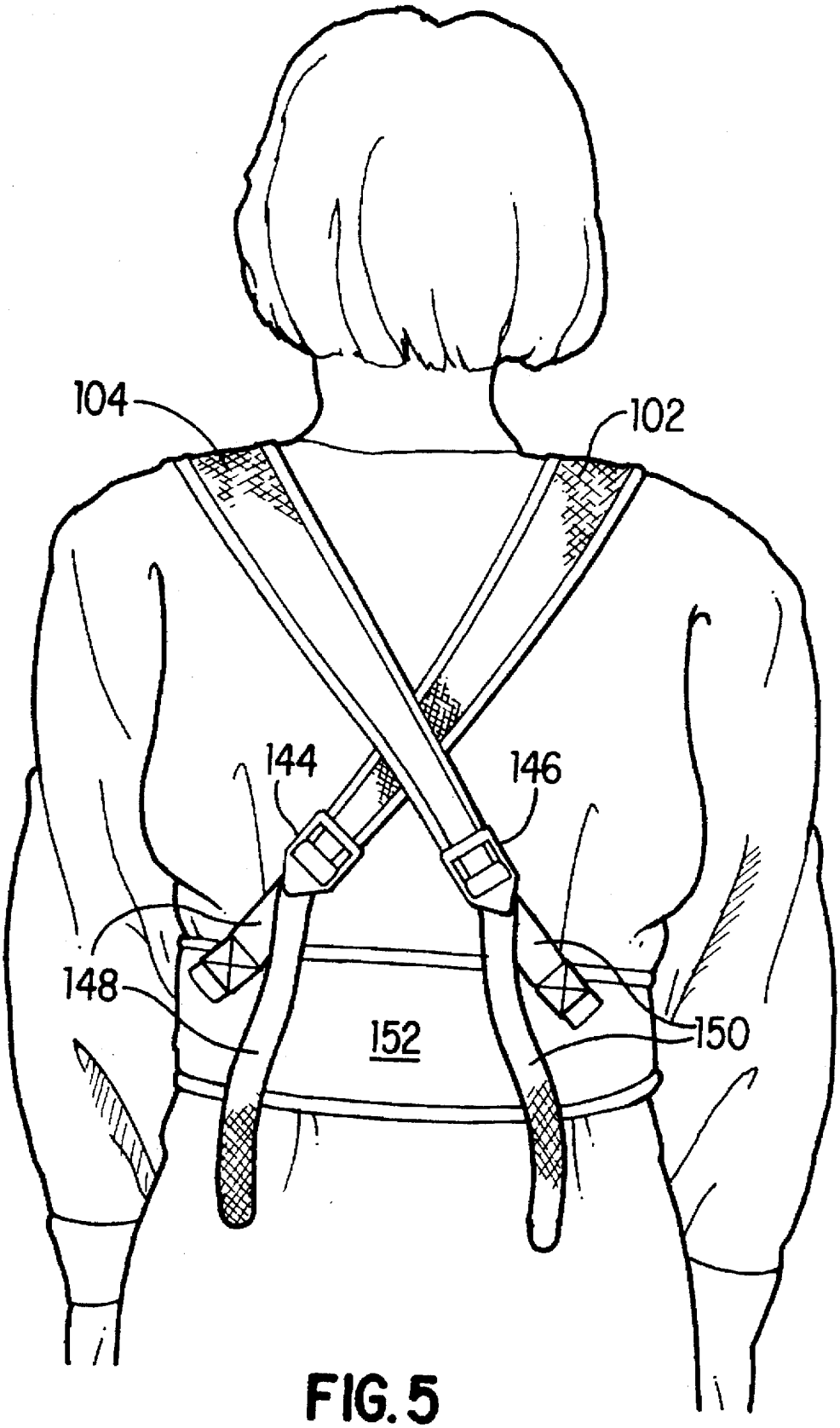
FIG. 5 is a rear view of the harness.

As shown in detail in FIGS. 3 and 5, the harness 100 includes first and second shoulder straps 102, 104 integrally connected and worn in a criss-crossed fashion. The first and second shoulder straps 102, 104 terminate in front of the wearer to form a u-shaped generally flat lower front portion 106. Centered within and permanently affixed to the u-shaped generally flat lower front portion 106 is a socket 108, the socket 108 serving as one of three attachment points for either the shell 200 or the sling 300. As illustrated in detail in FIG. 4, the socket 108 is generally u-shaped having flared upper ends 110 and terminating in a generally circular cavity 112, whose use will become apparent below. Laterally existing on both sides of the socket 108 are first and second waist receiving tethers 114, 116 terminating in first and second waist strap receiving buckles 118, 120. Traversing upward on the front of the harness 100 are first and second pockets 122, 124 followed by first and second shell receiving tethers 126, 128. The first and second shell receiving tethers 126, 128 terminate in first and second shell receiving buckles 130, 132. Directly above the attachment points for the first and second shell receiving tethers 126, 128 are first and second bib receiving snaps 134, 136 for receiving the detachable bib 400. Traversing further up the first and second shoulder straps 102, 104, permanently affixed above the first and second bib receiving snaps 134, 136, are first and second D-rings 138, 140.

Permanently affixed to the second shoulder strap 104 is a shoulder tether 142, serving to hold the second shoulder strap 104 in a criss-cross position in relation to the first shoulder strap 102. As best illustrated in FIG. 5, the first and second shoulder straps 102, 104 terminate behind the wearer in first and second shoulder adjustment buckles 144, 146. As discussed in more detail below, the first and second shoulder adjustment buckles 144, 146 exist to adjust the length of the first and second shoulder straps 102, 104. First and second support belt connection straps 148, 150, which interact with the first and second shoulder adjustment buckles 144, 146, serve both to connect the first and second shoulder straps 102, 104 to the support belt 152 and to adjustably fit the harness 100 to its wearer. Referring back to FIG. 3, permanently attached along the lateral expansion of the support belt 152 are first and second waist straps 154, 156. The first and second waist straps 154, 156 terminate in first and second waist strap buckles 158, 160, which mate with the first and second waist strap receiving buckles 118, 120 attached to the front of the harness 100. First and second sling receiving tethers 162, 164, terminating in first and second sling receiving buckles 166, 168 (shown in FIG. 9D) are permanently attached to the support belt 152 at the same location as the first and second waist straps 154, 156.

Figure 6:
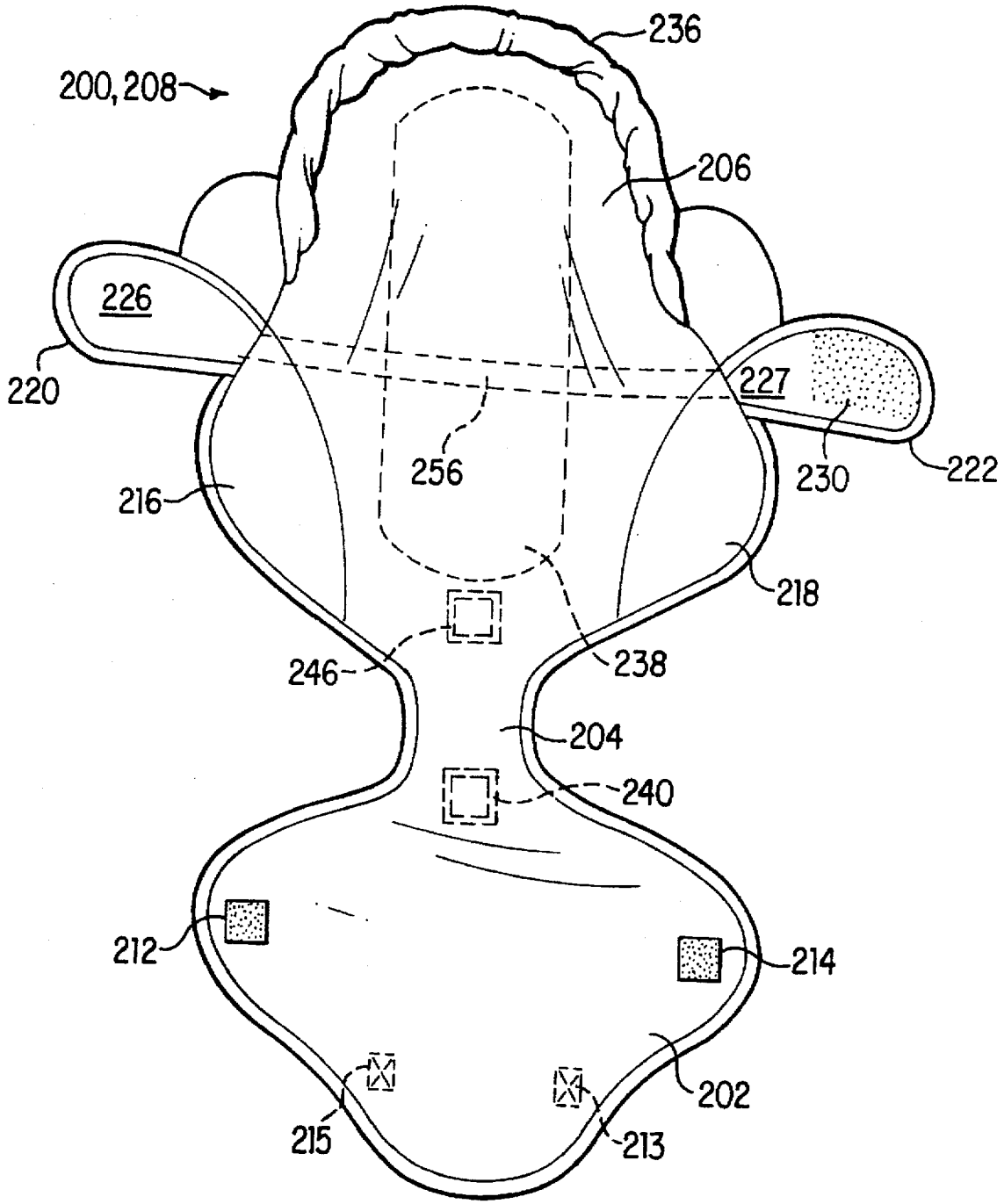
FIG. 6 is a front view of the shell.
Figure 7:
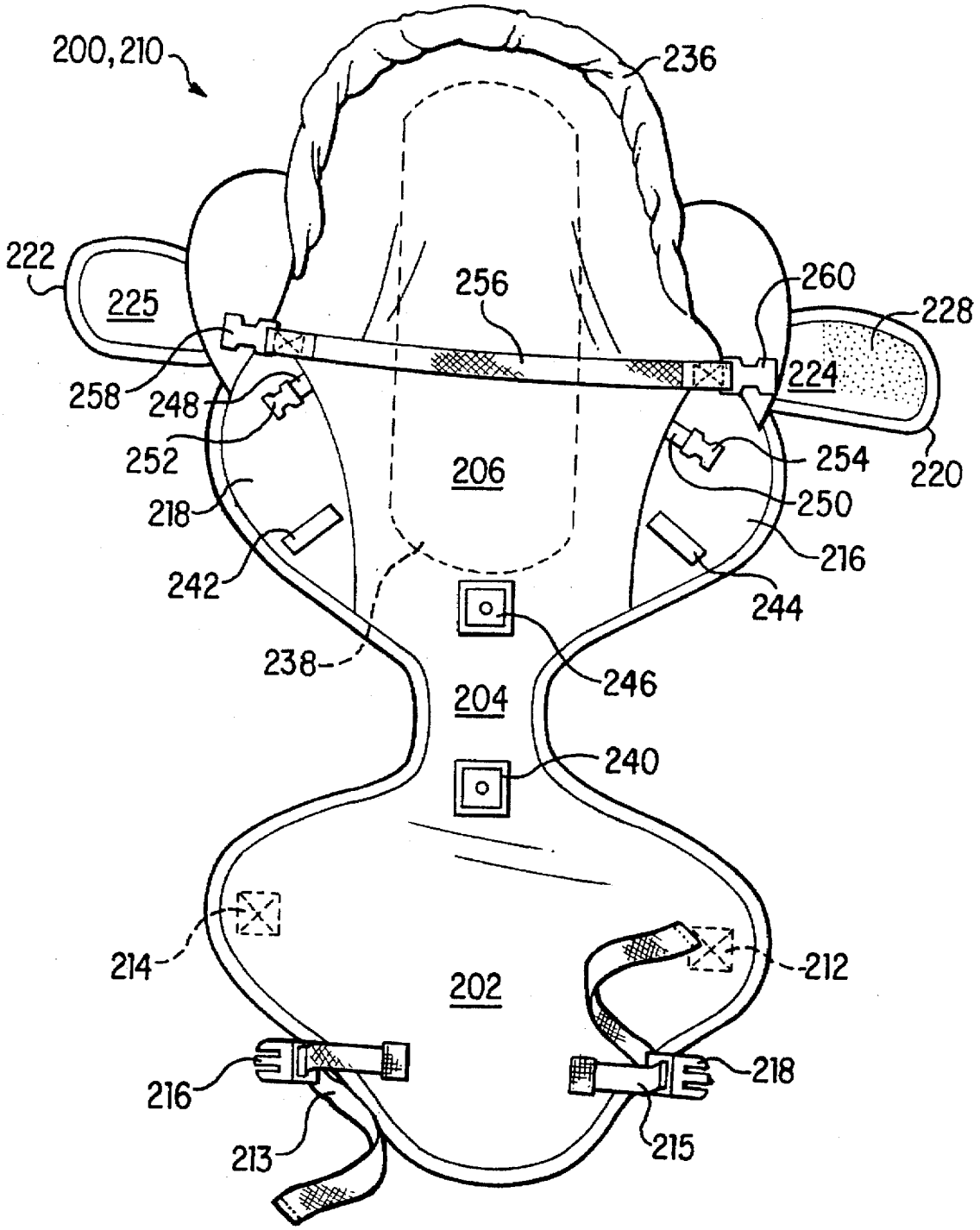
FIG. 7 is a rear view of the shell.
Figure 9A:
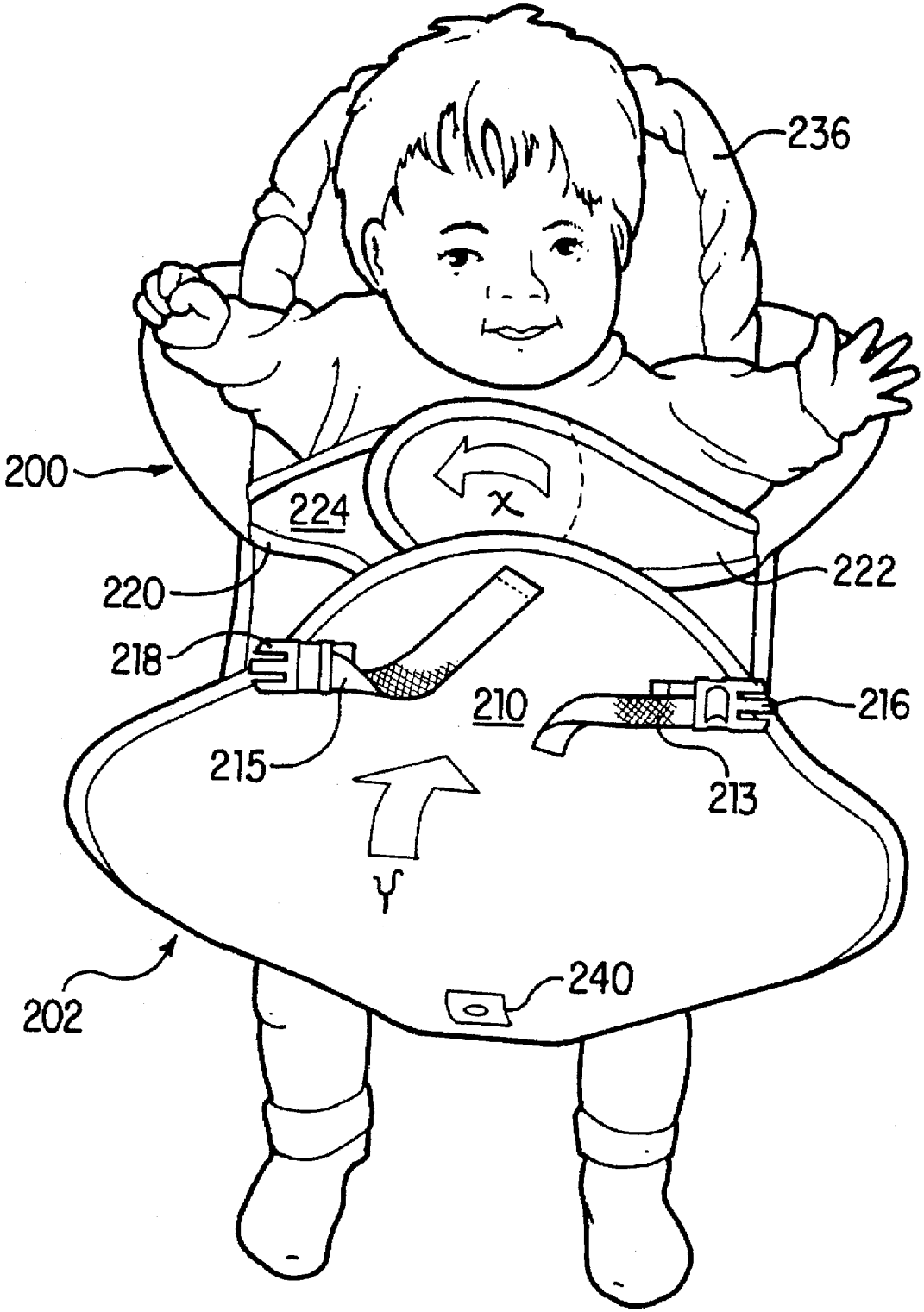
FIG. 9A illustrates the interaction between the infant and the shell.
Figure 9B:
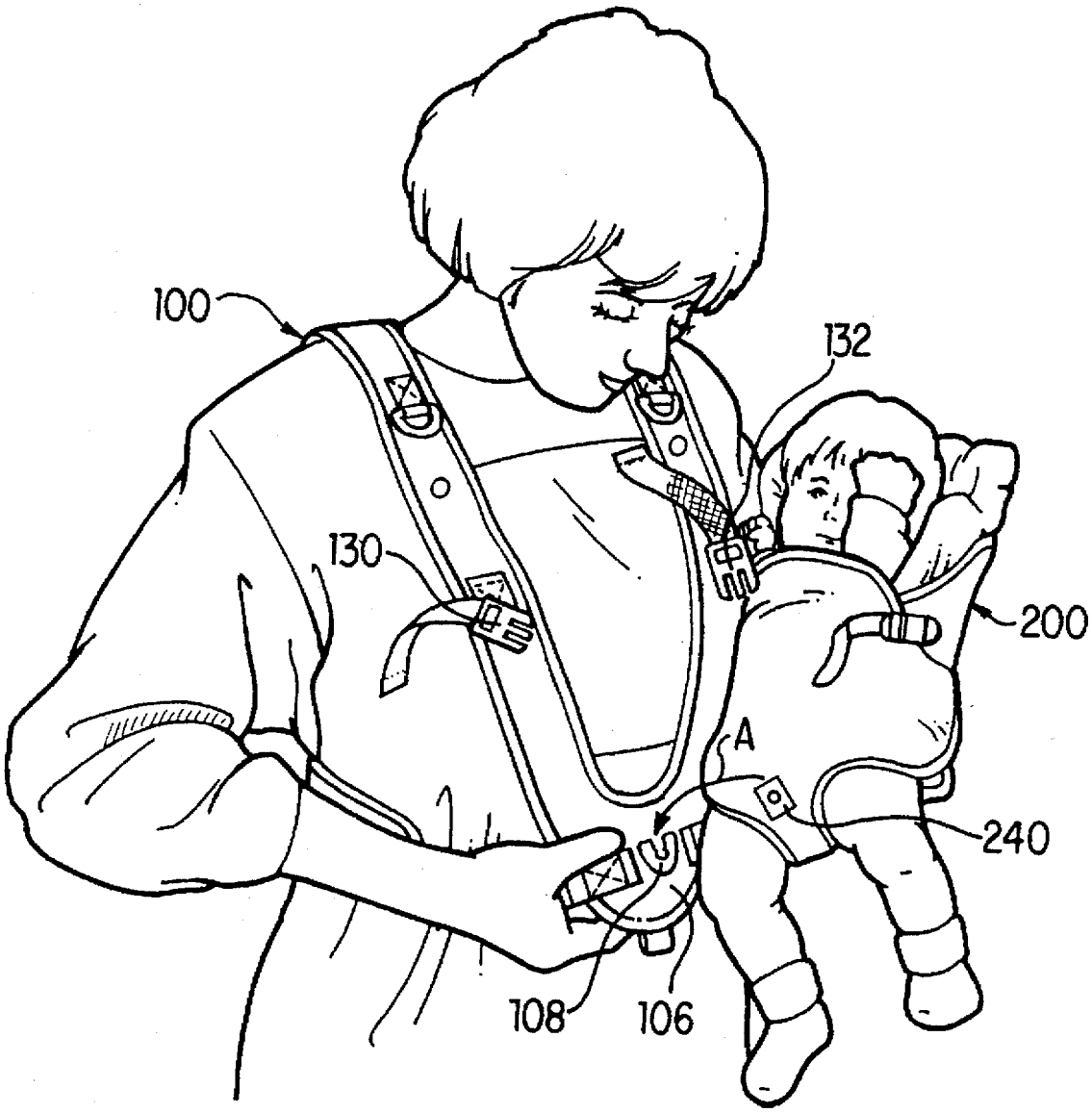
FIG. 9B illustrates the interaction between the socket and the shell when the shell is oriented facing the wearer.

The shell 200 is the enclosure in which the infant resides. Reference is now made to FIGS. 6, 7 and 9A wherein the shell 200 of the present invention is illustrated. The shell 200 includes lower, center and upper portions 202, 204, 206, the center portion 204 separating the upper and lower portions 202, 206, much like a conventional diaper. The shell 200 further includes a front surface 208 and a rear surface 210. The front surface 208, shown in detail in FIG. 6, has a lower portion 202 with upper attributes shaped to accommodate the infant's legs and lower attributes to cover the infant's torso when the infant is secured in the shell 200. The lower portion 202 includes first and second side flap fasteners 212, 214, whose use will become apparent below. Along the periphery of the upper portion 206 are first and second cushion ears 216, 218, which serve to protect and comfort the infant while nestled within the shell 200. Attached near the attachment points of the first and second cushion ears 216, 218 are first and second chest straps 220, 222. The first and second chest straps 220, 222, having first surfaces 224, 225 and second surfaces 226, 227, include first and second chest strap fastening means 228, 230. In a preferred embodiment, the first and second chest strap fastening means 228, 230 are comprised of a conventional hook and loop fastener construction. Located on the first surface 224 of the first chest strap 220 is the first chest strap fastening means 228. Located on the second surface 227 of the second chest strap 222 is of the second chest strap fastening means 230. Commencing near the attachment points of the first and second chest straps 220, 222 and traversing the upper periphery of the upper portion 206 of the shell 200 is a padded infant head support portion 236. Included within the upper portion 206 of the shell 200 is a rigid battens 238 (shown in hidden lines), which serves to reinforce the structure of the shell 200 and to provide additional comfort to the infant.

Illustrated in detail in FIG. 7 is the rear surface 210 of the shell 200, which is described below. Permanently attached to the lower portion 202 of the rear surface 210 of the shell 200 are first and second side strap tethers 213, 215 to which are attached first and second side strap slip buckles 216, 218. Located near the intersection between the lower portion 202 and the center portion 204 is a first attachment button 240. Permanently attached to the lower aspects of the upper portion 206 are first and second elongated side flap receiving fasteners 242, 244. The first and second elongated side flap receiving fasteners 242, 244 are affixed to the shell 200 and shaped to mate with the first and second side flap fasteners 212, 214 in an adjustable manner. Centered and permanently attached to the lower aspects of the upper portion 206 is a second attachment button 246, which may be identical in shape to the first attachment button 240. Above the second attachment button 246, and attached to the upper portion 206 by third and fourth side strap tethers 248, 250 are first and second side strap receiving buckles 252, 254. Located near the attachment points of the first and second cushion ears 216, 218 and spanning the distance therebetween is a shell tether 256. The shell tether 256 is permanently attached to the fabric comprising the upper portion 206 of the shell 200 and terminates at either end in first and second shell buckles 258, 260.

Figure 8:
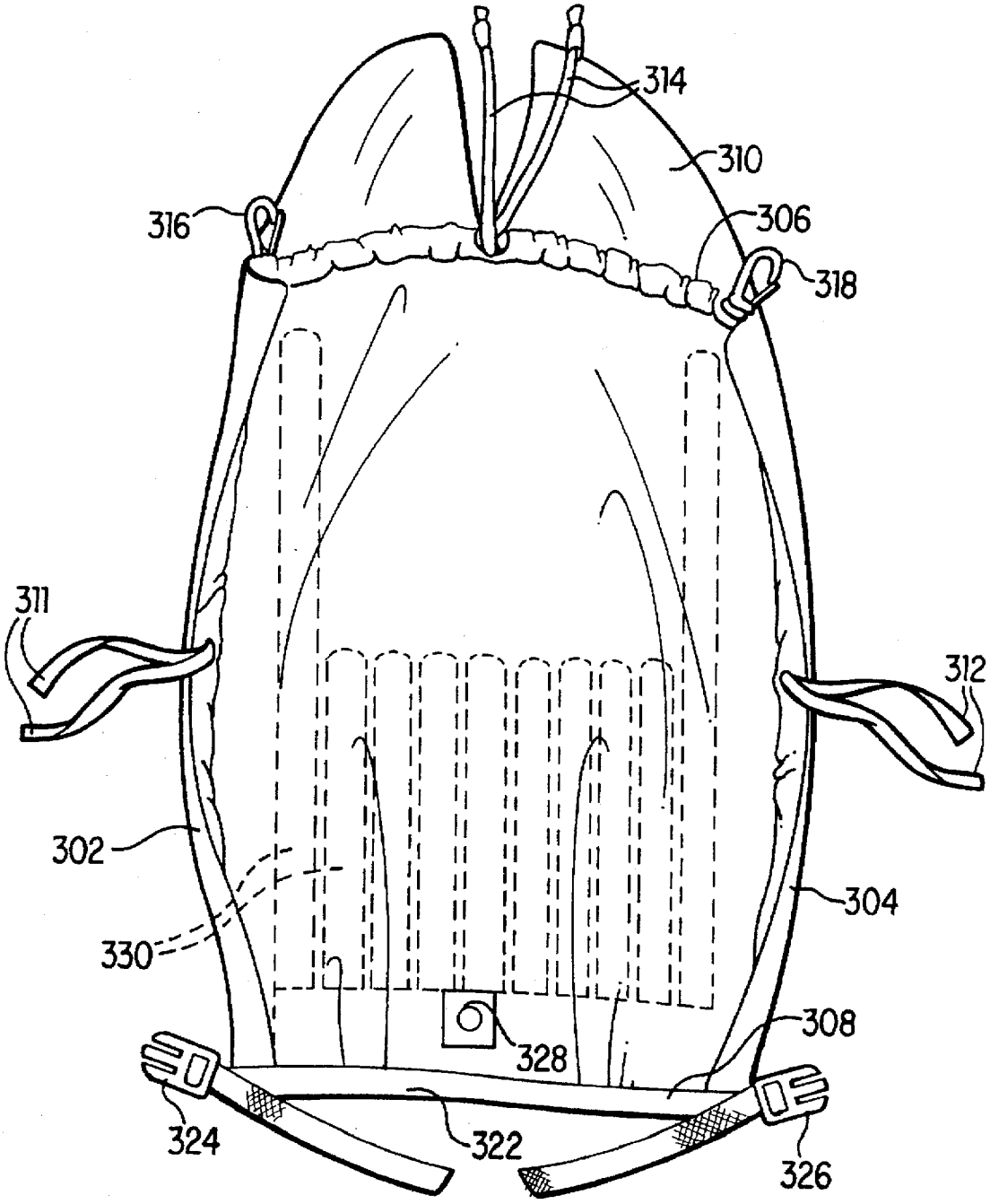
FIG. 8 is a front view of the sling.

With reference to FIG. 8, the sling 300 will now be described. The sling 300 is generally rectangular in shape, having first and second vertical edges 302, 304, upper and lower horizontal edges 306, 308, and an upper sling portion 310. Integrated along the first and second vertical edges 302, 304 are first and second drawstring 311, 312. Similarly, a horizontal drawstring 314 is integrated along the upper horizontal edge 306. Permanently affixed at the intersection between the upper and lower vertical edges 302, 304 and the upper horizontal edge 306 are first and second J-hooks 316, 318. In close proximity to the upper horizontal edge 306 is the upper sling portion 310. The upper sling portion 310 is generally semi-elliptical in shape and is separated at its midpoint into two halves. The upper sling portion 310 is reinforced by stitching to provide for a more rigid structure. Residing along the lower horizontal edge 308 is a sling tether 322. Located at the terminal ends of the sling tether 322 are first and second sliding sling buckles 324, 326. Located slightly above the second horizontal edge 308 is a sling attachment button 328. The sling 300 is reinforced with sling battens 330 (shown in hidden lines) which provides additional support and shape to the sling to permit the infant to safely and comfortably rest in the sling 300 without the sling folding over or buckling when the infant is placed in the sling 300 without being in the shell 200.

The sling 300 is an optional component of the invention. Accordingly, one embodiment of the invention is possible without the sling 300 and the D-rings 138, 140 and the sling receiving buckles 166, 168.

OPERATION

The operational characteristics of this invention will now be described. In general, the operative configurations, illustrated in FIGS. 2A through 2E, require the attendant to wear the harness 100. Referring back to FIGS. 3 and 5, the first and second shoulder straps 102, 104 are draped over the attendant's shoulders, allowing the u-shaped generally planar portion 106 to rest near the attendants waistline. The harness 100 is positioned such that the first and second waist straps 154, 156 are around the attendant's waist and the support belt 152 rests on the attendant's lower back. The first and second waist strap receiving buckles 118, 120 are then mated with the first and second waist strap buckles 158, 160. The interaction between the first and second waist straps 154, 156 and the first and second waist strap buckles 158, 160 allow the attendant to adjust the harness 100 to fit the attendant. In order to adjust the length of the harness 100 to the length of the attendant's torso, the attendant pulls on the terminal ends of the first and second support belt connection straps 148, 150, causing the first and second support belt connection straps 148, 150 to slide in relation to the first and second shoulder adjustment buckles 144, 146.

Referring back to FIGS. 6, 7 and 9A, the method of placing the infant in the shell will now be described. The shell 200 is placed on a level surface, orienting the shell 200 such that the front surface 208 is visible and the padded infant head support portion 236 is at the top. The infant is placed on the shell 200 so that the infant's head is resting just below the padded infant head support portion 236. The first and second chest straps 220, 222 are connected across the infant's chest, below the infant's arms, by mating the first chest strap fastening means 228, located on the first surface 224 of the first chest strap 220, with the second chest strap fastening means 230, located on the second surface 226 of the second chest strap 222 (designated by Arrow X in FIG. 9A). The lower portion 202 of the shell 200 is lifted between the infant's legs, much like a conventional diaper, so that the rear surface 210 of the lower portion 202 is now visible (designated by Arrow Y in FIG. 9A). The first and second side strap slip buckles 216, 218 are inserted into the first and second side strap receiving buckles 252, 254, effectively securing the lower portion 202 of the shell 200 around the infant's torso. The interaction between the first and second side strap tethers 213, 215 and the first and second side strap slip buckles 216, 218 allows the attendant to adjust the size of the shell to fit the infant therein. Completing the process, the first and second side flap fasteners 212, 214, permanently affixed to the front surface 202 of the shell 200, are mated with the first and second elongated side flap receiving fasteners 242, 244, permanently affixed to the rear surface 210 of the shell 200. The elongated aspects of the first and second elongated side flap receiving fasteners 242, 244 allow the attendant to adjustably fit the lower portion 202 of the shell 200 around the infant.

Figure 9C:
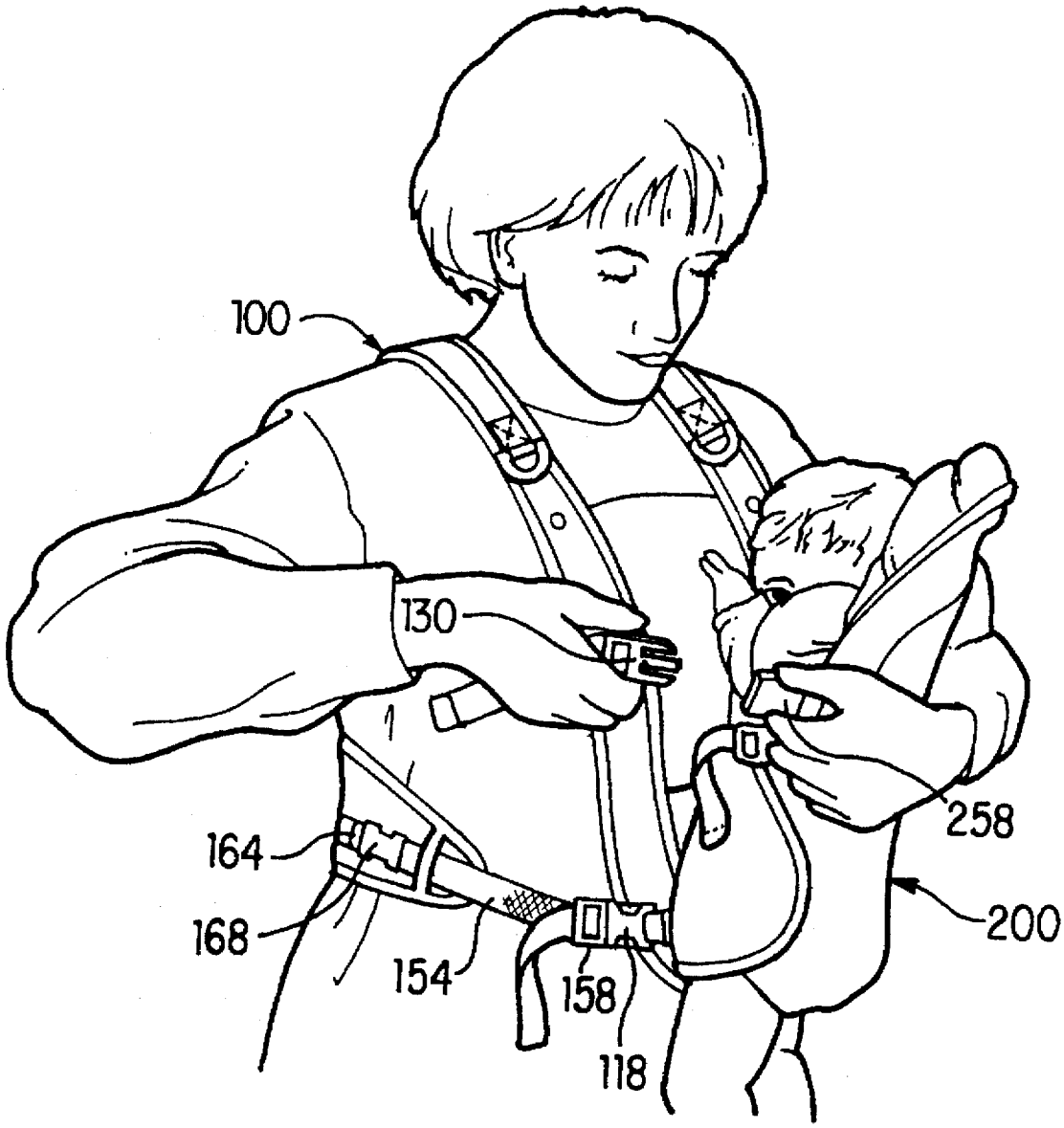
FIG. 9C illustrates the interaction between the harness and the shell when the shell is oriented facing the wearer.
Figure 13:
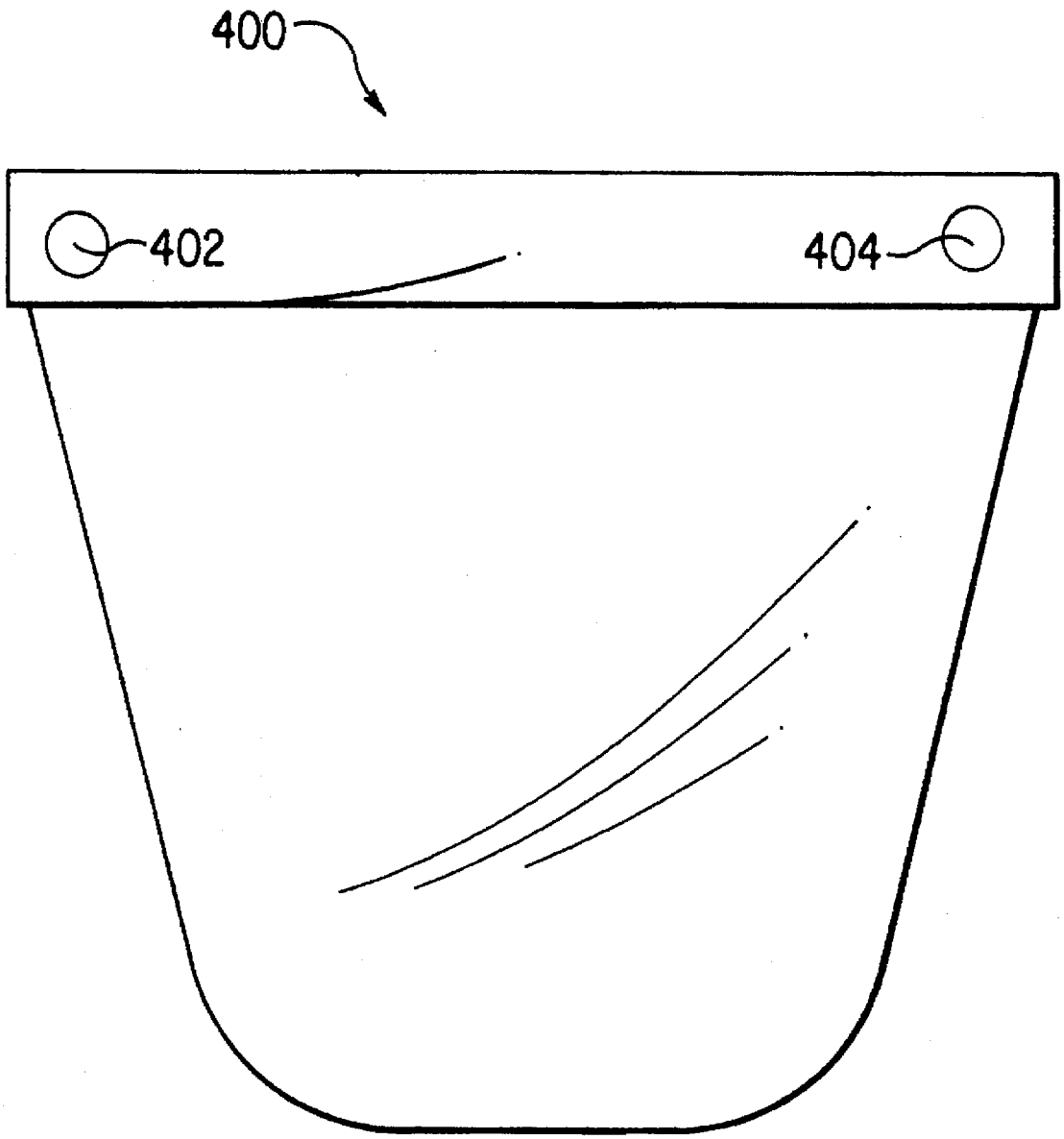
FIG. 13 is a front view of the bib portion.

The interaction between the harness 100 and the shell 200 will now be described. The attendant has the option of orienting the infant so that he is either facing the attendant or facing the direction in which the attendant is traversing. When orienting the front infant carrier so that the infant is facing the attendant, the attendant may want to attach the optional bib portion 400 to the harness 100 to prevent the attendant's clothing from getting soiled, as infants up through the teething stage tend to drool almost continuously and also regurgitate small amounts of their food or milk, especially following a feeding. The bib portion 400, illustrated in FIG. 13, is attached by mating the first and second bib receiving snaps 134, 136 with the first and second bib snaps 402, 404. The infant, already fitted within the shell 200 in the manner described above, is held by the attendant so that the attendant and the infant are face-to-face. As illustrated by Arrow A in FIG. 9B, while supporting the infant's back and bottom, the attendant inserts the first attachment button 240, located near the intersection between the lower portion 202 and the center portion 204 of the shell 200, into the top of the socket 108 (shown in detail in FIG. 4), which is affixed to the u-shaped generally planar portion 106 on the front of the harness 100. The first attachment button 240 is slid down within the socket 108 until it rests within the generally circular cavity 112 (shown in FIG. 4). Cradling the infant with one arm, the attendant further secures the shell 200 to the harness 100 by mating the first and second shell buckles 258, 260 with the first and second shell receiving buckles 130, 132 (as shown in FIG. 9C). The interaction between the first and second shell receiving buckles 130, 132 and the first and second shell receiving tethers 126, 128 allows for adjusting the distance between the attendant's torso and the infant.

Figure 2A:
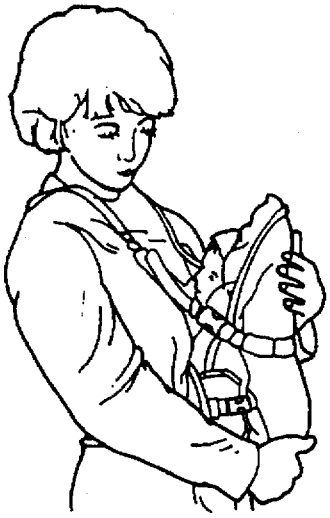
FIG. 2A shows a perspective view of the front infant carrier when in its rearward facing position.
Figure 2B:
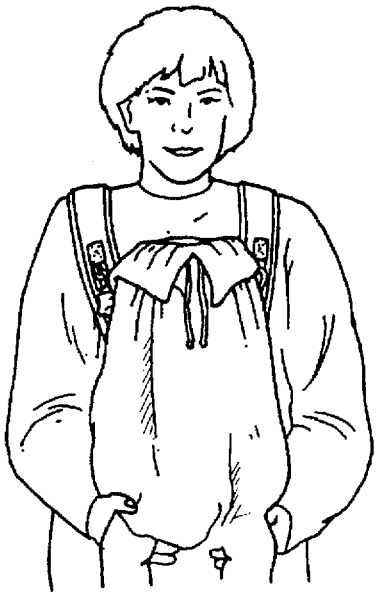
FIG. 2B shows a perspective view of the front infant carrier when in its rearward facing position with the sling serving as a weather protector.
Figure 2C:
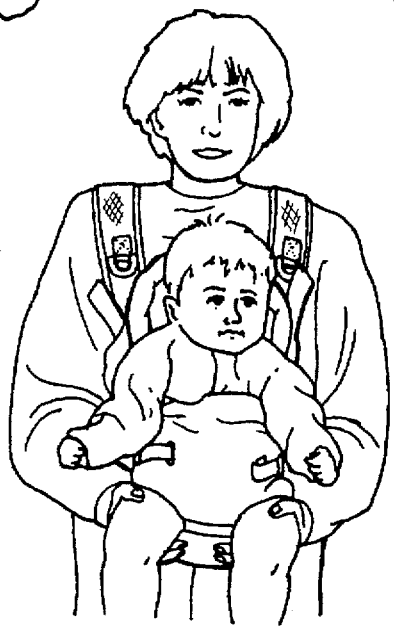
FIG. 2C shows a perspective view of the front infant carrier when in its forward facing position.
Figure 9D:
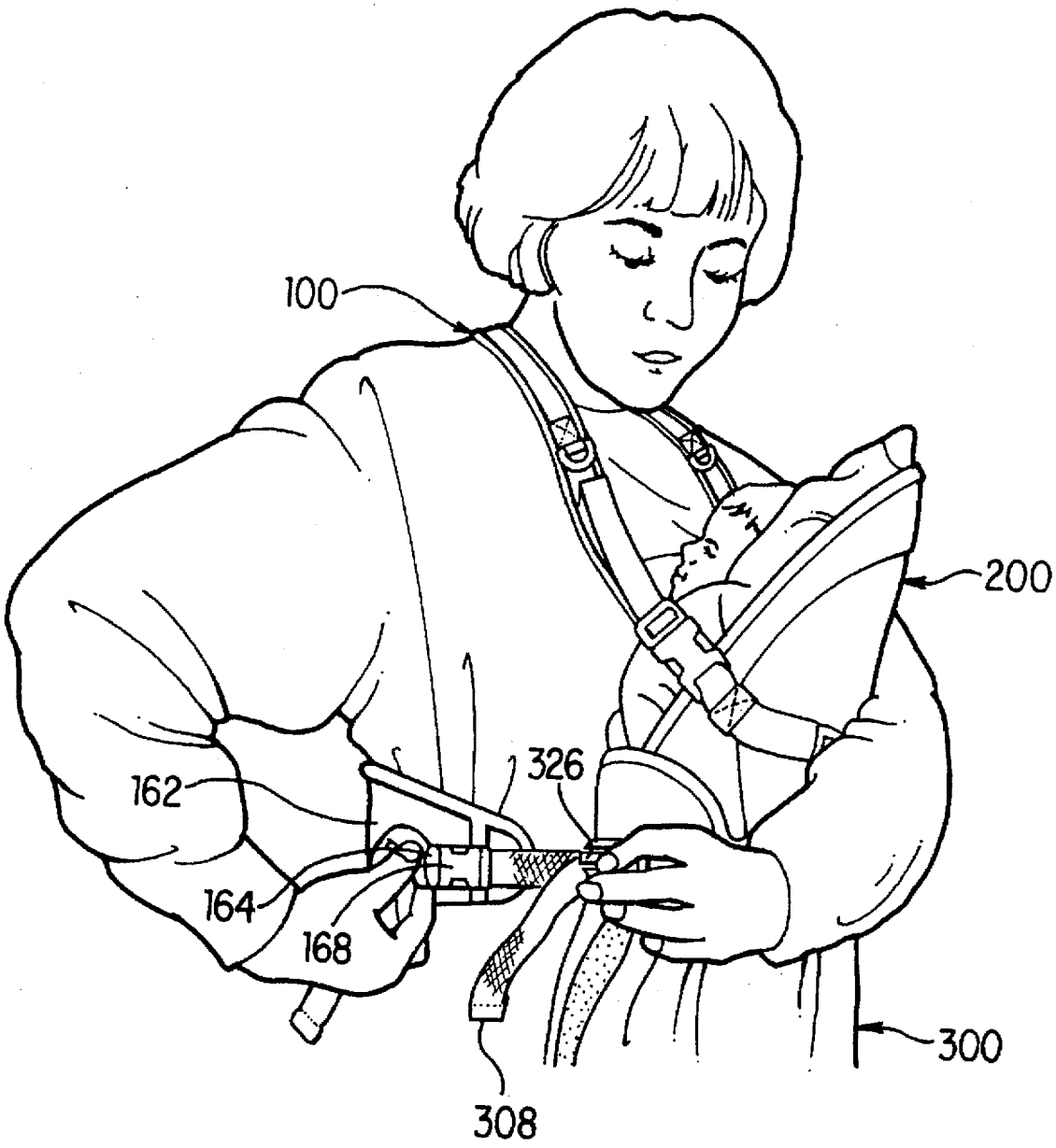
FIG. 9D illustrates the interaction between the support belt and the sling when the sling is utilized as a weather protector.
Figure 9E:
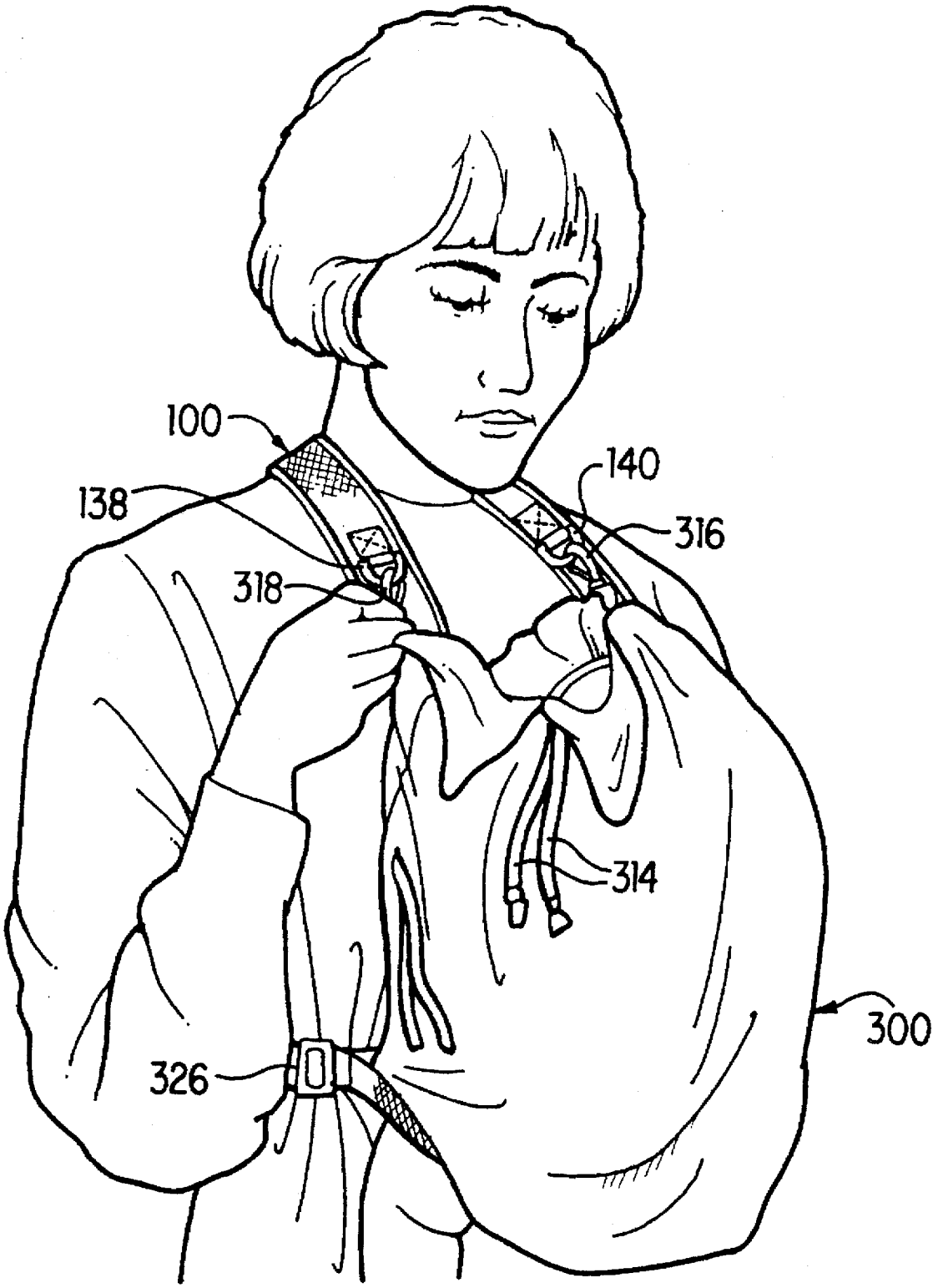
FIG. 9E illustrates the interaction between the D-clips on the harness and the J-hooks on the sling when the sling is used as a weather protector.

Orienting the infant so that the infant faces the attendant provides the attendant with the option of attaching the sling 300 to the harness 100, utilizing the sling 300 as a weather protector. As illustrated in FIG. 9D, to secure the lower aspects of the sling 300 to the harness 100, the first and second sliding sling buckles 324, 326, located on the sling 300 at the second horizontal edge 308, are mated with the first and second sling receiving buckles 166, 168, which are attached to the support belt 152. Since the first shell attachment button 240 of the shell is mounted in the socket 108, the sling attachment button 328 is not used. The upper aspects of the sling 300 are secured to the harness 100 by attaching the first and second J-hooks 316, 318, which are permanently affixed at the intersection between the first and second vertical edges 302, 304 and the first horizontal edge 306, to the first and second D-rings 138, 140 on the harness 100, as illustrated in FIG. 9E. To gather the sling 300 (serving as a weather protector in this instance) around the infant as shown in FIGS. 2B and 9E, the attendant pulls and ties the first and second drawstrings 310, 312 which are integrated along the first and second vertical edges 302, 304. To gather the sling 300 over the top of the infant's head, the attendant pulls and ties the horizontal drawstring 314 which is integrated along the first horizontal edge 306.

Figure 10A:
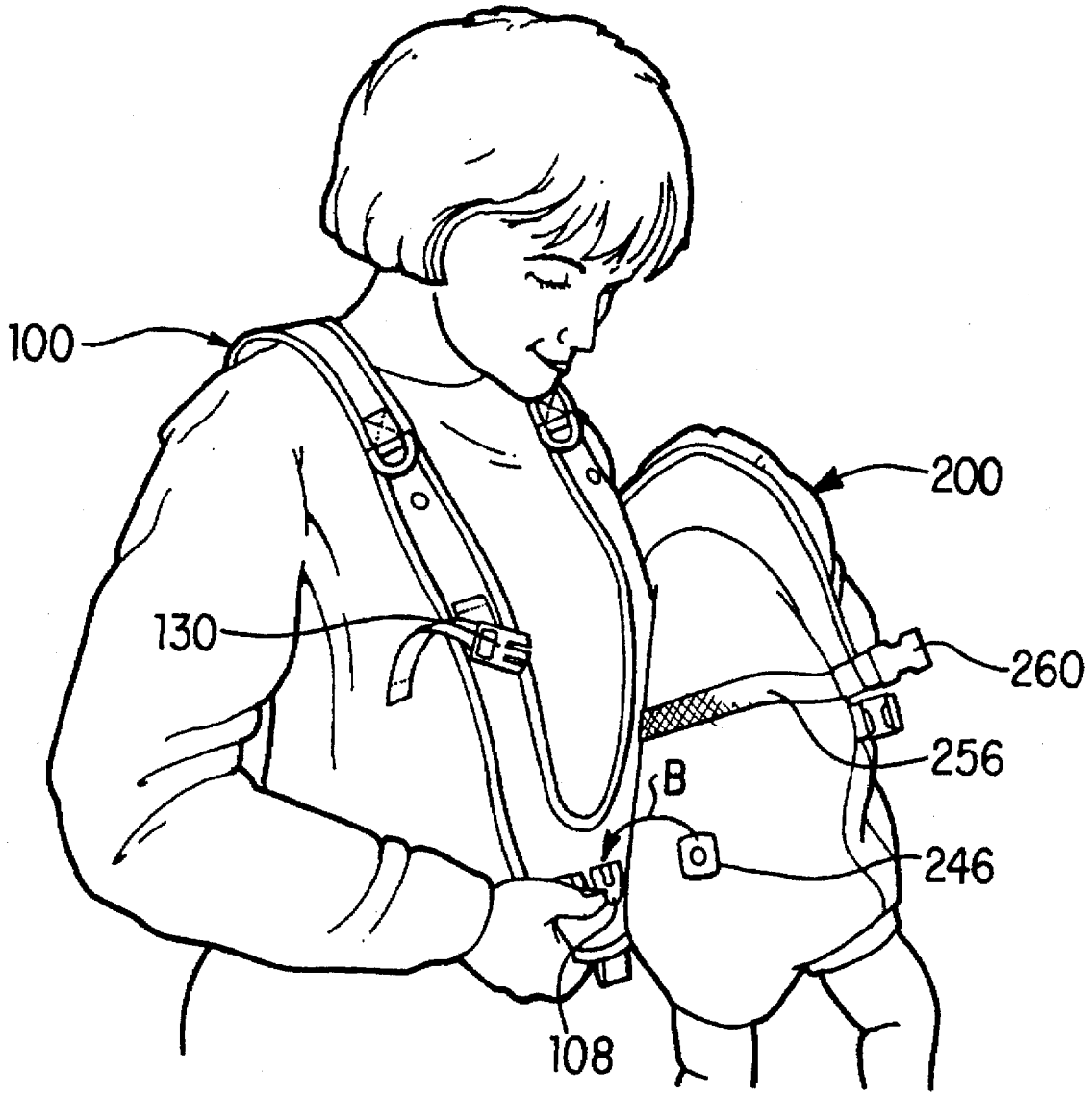
FIG. 10A illustrates the interaction between the socket and the shell when the shell is oriented away from the wearer.
Figure 10B:
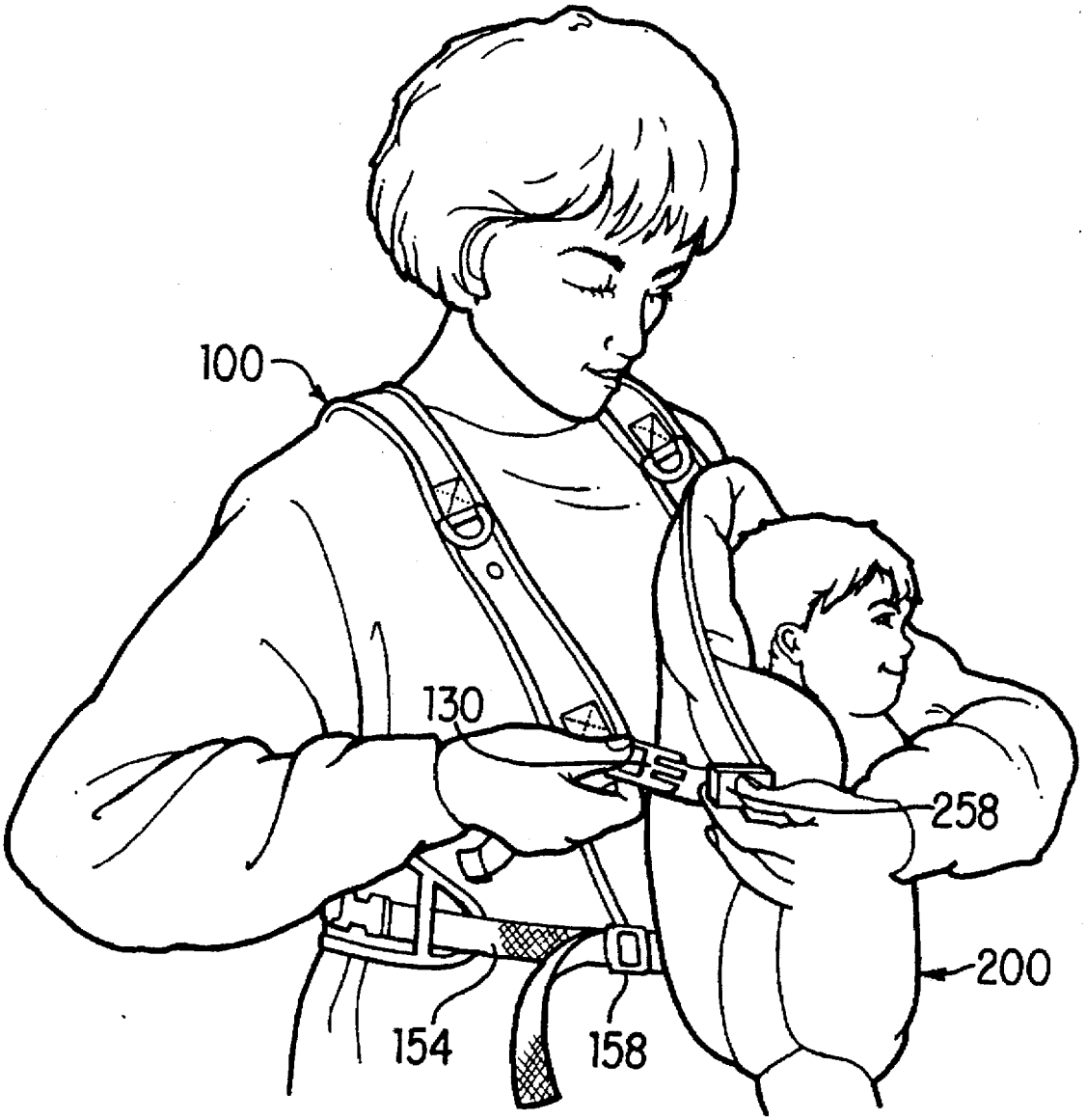
FIG. 10B illustrates the interaction between the harness and the shell when the shell is oriented away from the wearer.
Figure 11:
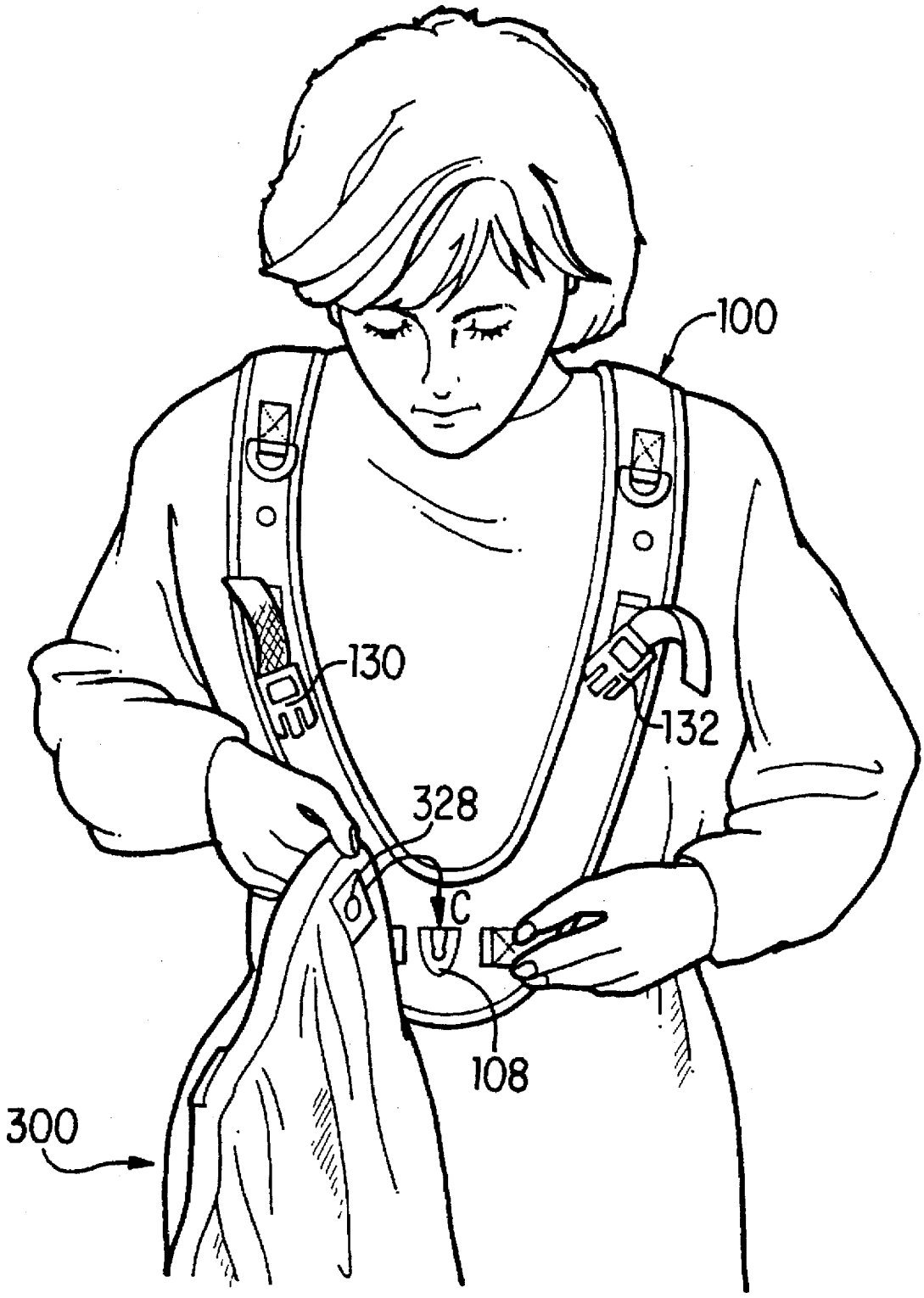
FIG. 11 illustrates the interaction between the socket and the sling when the sling is used as a carrier with the shell not attached to the harness.

In an effort to allow the infant to interact directly with the outside environment, the shell alternatively may be positioned so that the infant is facing the direction the attendant is traveling. The infant, already fitted within the shell 200 in the manner described above, is held by the attendant so that file infant is facing away from the attendant. As illustrated by Arrow B in FIG. 10A, while supporting the infant with one arm, the second attachment button 246, which is attached to the rear surface 210 of the upper portion 206 of the shell 200, is inserted into the top of the socket 108, which is affixed to the u-shaped generally planar portion 106 on the front of the harness 100. The second attachment button 246 is slid down within the socket 108 until it rests within the generally circular cavity 112. Cradling the infant with one arm, the attendant further secures the shell 200 to the harness 100 by mating the first shell buckle 258 with the second shell receiving buckle 132 and mating the second shell buckle 260 with the first shell receiving buckle 130 (as shown in FIG. 10B). The interaction between the first and second shell receiving buckles 130, 132 and the first and second shell receiving tethers 126, 128 allows for adjusting the distance between the attendant's torso and the infant.

Figure 2D:
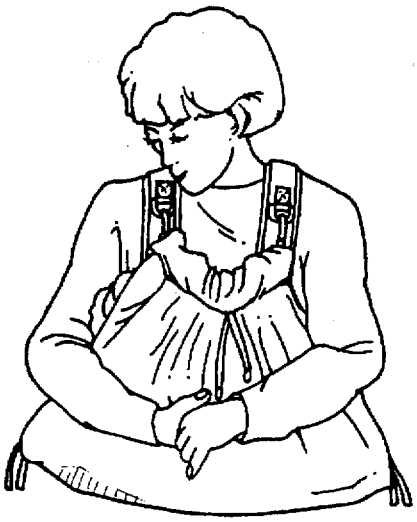
FIG. 2D shows a perspective view of the front infant carrier when utilizing the sling as a privacy shield.
Figure 2E:
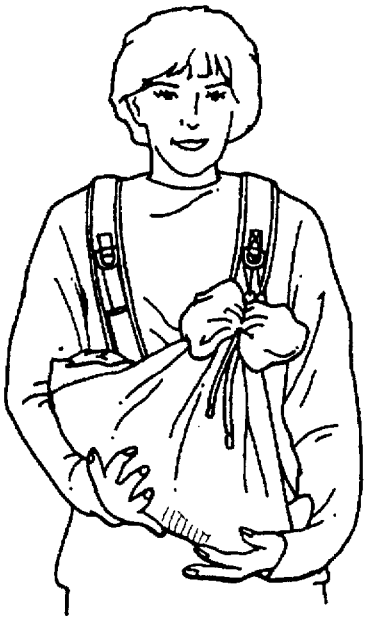
FIG. 2E shows a perspective view of the front infant carrier when utilizing the sling as a carrier.
Figure 12:
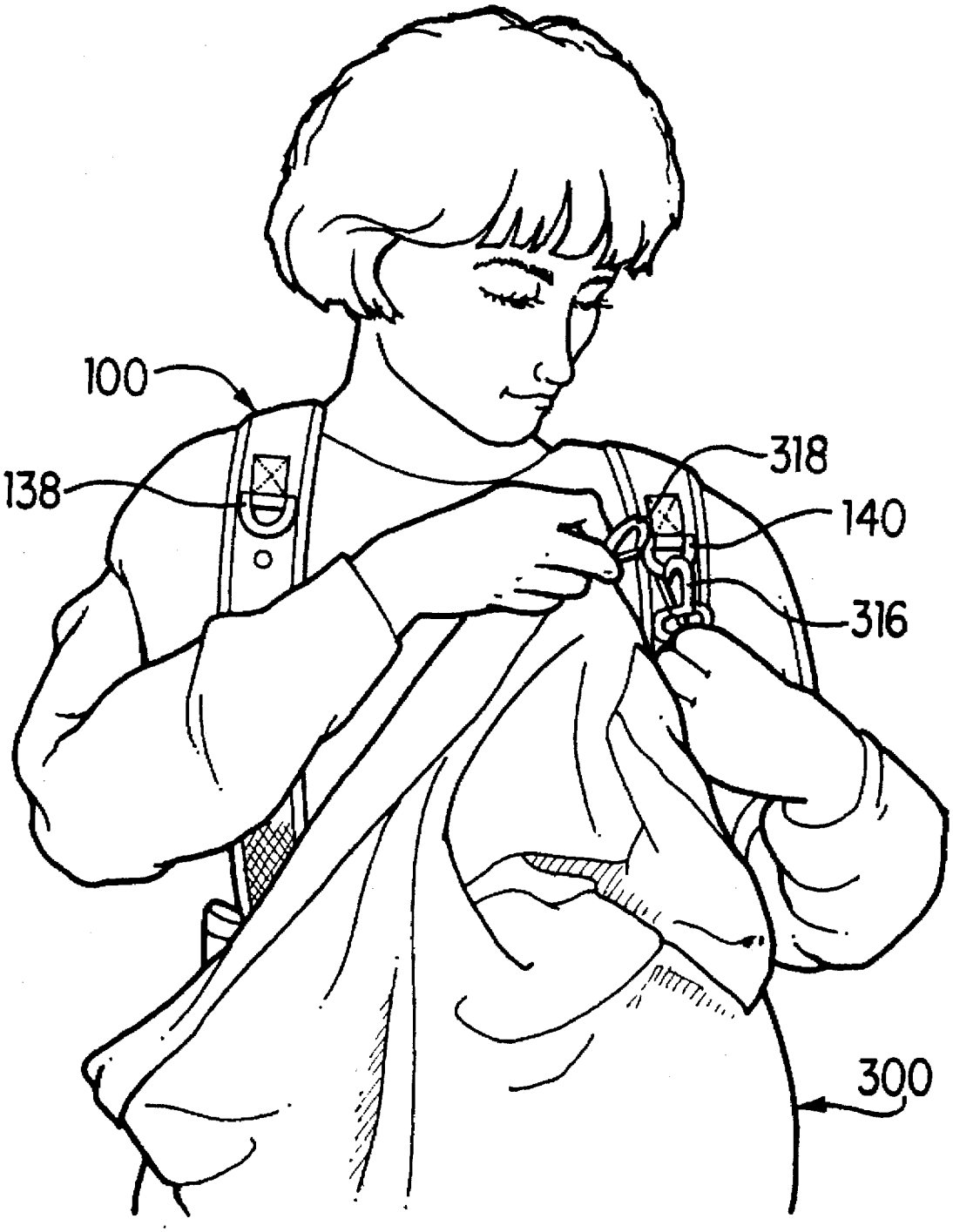
FIG. 12 illustrates the interaction between the D-clips on the harness and the J-hooks on the sling when the sling is utilized as a carrier in an of itself.

In addition to using the sling 300 as a weather protector when the shell 200 is attached to the harness 100, it may be used as a carrier in and of itself. Referring to Arrow C in FIG. 11, the sling attachment button 328, permanently attached to the sling 300 near the second horizontal edge 308, is inserted into the socket 108, which is affixed to the u-shaped generally planar portion 106 on the front of the harness 100. The sling attachment button 328 is slid down within the socket 108 until it rests within the generally circular cavity 112. First and second pockets 122, 124 (shown in FIG. 3) are provided to place the first and second shell receiving buckles 130, 132 when the shell 200 is not in use. To secure the lower corners of the sling 300 to the harness 100, the first and second sliding sling buckles 324, 326, located on the sling 300 at the second horizontal edge 308, are mated with the first and second sling receiving buckles 166, 168 (shown in detail in FIG. 9D), which are attached to the support belt 152. As illustrated in FIG. 12, the upper aspects of the sling 300 are secured to the harness 100 by attaching the first and second J-hooks 316, 318, which are permanently affixed at the intersection between the first and second vertical edges 302, 304 and the first horizontal edge 306, to the first and second D-rings on the harness 138, 140. Attaching the first J-hook 316 to the first D-ring 138 and the second J-hook 318 to the second D-ring 140 allows the attendant to privately nurse the infant (as shown in FIG. 2D). The first and second J-hooks 316, 318 may also be attached to the same D-ring 138, 140 to facilitate carrying the infant in the sling 300 (as shown in FIG. 2E and FIG. 12). When the carrier is used in the configuration shown in FIG. 2E and FIG. 12, the infant may rest in the sling 300 either while resting in the shell 200 (the shell 200 is not attached to the harness 100 but rests in the sling 300) or the infant may rest in the sling 300 without the shell 200. The sling 300 is reinforced with sling battens 330 (shown in hidden lines in FIG. 8), providing the sling 300 with structural reinforcement to aid in supporting the infant residing therein.

What is claimed is:

1. A carrier for facilitating carrying of a child by a person, comprising:

a harness symmetrical about a central vertical axis and adapted to be worn by the person, comprising a side having an upper portion, a lower portion, a first shell connector, a second shell connector and a third shell connector, said first and second shell connectors arranged laterally spaced on said upper portion and said third shell connector arranged below said first and second shell connectors and on said central axis; and a shell separate from said harness including a fourth shell connector, a fifth shell connector, a first selectable connector and a second selectable connector, wherein said shell is adaptable to form a configuration to hold the child said configuration having a first shell side substantially opposing a second shell side, said first selectable connector being disposed on said first shell side and said second selectable connector being disposed on said second shell side, wherein said shell in said configuration is selectively releasably attachable to said harness by attaching, said first selectable connector to said third connector, said first shell connector to said fourth shell connector, and said second shell connector to said fifth shell connector to position the child facing toward said side of said harness, or by attaching said second selectable connector to said third shell connector, said first shell connector to said fifth shell connector, and said shell second connector to said fourth shell connector to position the child facing away from said side of said harness.

2. A carrier according to claim 1, wherein one of said third shell connector, and said first and second selectable connectors comprises a socket and the other one of said third shell connector, and said first and second selectable connectors comprises a peg releasably engageable with said socket.

3. A carrier according to claim 1, wherein said first and second selectable connectors are substantially the same.

4. A carrier according to claim 1, wherein said harness further comprises a waist strap for encircling the wear's waist.

5. A carrier according to claim 1, further comprising:

a sling adaptable to hold the child having a first set of sling connectors; and a second set of sling connectors on said harness removably connectable with said first set of sling connectors.

6. A carrier according to claim 1, further comprising:

a sling having a first set of sling connectors, and a second set of sling connectors disposed on said harness being removably connectable with said first set of sling connectors to cover said shell.

7. A carrier according to claim 1, wherein said first and second shell connectors comprise a receiving buckle and said fourth and fifth shell connectors comprise an attaching buckle.

8. A carrier according to claim 5, wherein said sling is connected to said second set of sling connectors on said harness to cover said shell, which holds the child.

9. A carrier according to claim 5, wherein said sling is connected to said harness and said shell is disposed in said sling.

10. A carrier according to claim 5, wherein said sling is comprised of fabric reinforced by flexible battens.

11. A child carrier, comprising:

a harness adapted to be worn by a person, comprising a side having an upper portion, a lower portion, a first set of connectors and a second set of connectors at least one of which is different than said first set of connectors;

a shell separate from said harness having a plurality, of shell connectors removably connectable to said first set of connectors on said harness to hold the child in an upright sitting position; and a sling, separate from said harness and said shell, having a plurality, of sling connectors removably connectable to said second set of connectors on said harness to hold the child in a reclined substantially horizontal position, wherein in a first arrangement of the child carrier said shell connectors are connected to said first set of connectors on said harness and the child is in said upright position, and in a second arrangement of the child carrier said sling connectors are connected to said second set of connectors on said harness and the child is in said reclined position.

12. A carrier according to claim 11, wherein said plurality of sling connectors on said harness includes a first centrally disposed connector and said second set of connectors on said harness include a second centrally disposed connector adapted to slidably receive said first centrally disposed connector.

13. A carrier according to claim 11, wherein said harness further comprises a waist strap for encircling the wearer's waist.

14. A carrier according to claim 11, wherein said sling is comprised of a fabric reinforced by flexible battens.

15. A carrier according to claim 14, wherein said harness further comprises a waist strap for encircling the wearer's waist.

16. The carrier of claim 14 wherein said flexible battens are resilient.

17. The carrier of claim 16 wherein said flexible battens are resilient in two directions.

18. A carrier according to claim 11, wherein said second connectors on said harness comprise a first D-ring and a second D-ring and said second connectors on said sling comprise a first J-hook and a second J-hook, wherein said first and second J-hooks are releasably engageable with said D-rings.

19. A carrier according to claim 11, wherein said sling connectors are connected to said second set of connectors on said harness in one of a first arrangement and a second arrangement.

20. A carrier according to claim 11, wherein said sling includes at least one drawstring.

21. A carrier according to claim 11, wherein said shell is configurable into a baby-holding configuration and said shell connectors include at least a first selectable connector and a second selectable connector opposing said first selectable connector in said baby-holding configuration.

* * * * *